US007310959B2

(12) United States Patent
Braun et al.

(10) Patent No.: US 7,310,959 B2
(45) Date of Patent: Dec. 25, 2007

(54) METHOD FOR ACTUATING A FAN USING A PLURALITY OF CHARACTERISTIC CURVES AND A CONTROL PROGRAM FOR CONTROLLING THE POWER OF THE FAN

(75) Inventors: Hans Braun, Stuttgart (DE); Ralf Körber, Stuttgart (DE); Michael Timmann, Eutingen (DE); Jochen Weeber, Filderstadt (DE)

(73) Assignee: Daimler AG, Stuttgart (DE)

( * ) Notice: Subject to any disclaimer, the term of this patent is extended or adjusted under 35 U.S.C. 154(b) by 494 days.

(21) Appl. No.: 10/966,103

(22) Filed: Oct. 18, 2004

(65) Prior Publication Data

US 2005/0081542 A1 Apr. 21, 2005

(30) Foreign Application Priority Data

Oct. 16, 2003 (DE) ..... 103 48 133

(51) Int. Cl.
*F25D 17/00* (2006.01)

(52) U.S. Cl. ..... 62/178; 62/158; 62/186; 123/41.11; 123/41.65; 416/39; 415/47

(58) Field of Classification Search ..... 62/157, 62/158, 178, 186; 236/49.3; 123/41.11, 123/41.1, 41.65; 416/39; 415/47
See application file for complete search history.

(56) References Cited

U.S. PATENT DOCUMENTS 4,806,832 A * 2/1989 Muller ..... 388/833
6,101,987 A 8/2000 Saur et al.
6,291,956 B1 * 9/2001 Ku ..... 318/445

FOREIGN PATENT DOCUMENTS

DE 197 28 814 A1 1/1999

* cited by examiner

*Primary Examiner*—Marc Norman
(74) *Attorney, Agent, or Firm*—Norman N. Kunitz; Fitch, Even, Tabin & Flannery

(57) ABSTRACT

The present invention relates to control of a fan during which the power of the fan is determined from the characteristic curves of the fan motor, the operating parameters of the cooling system and the reference variables which are predefined in the form of temperature levels. The various temperature levels which are to be set have different associated characteristic curves for actuating the fan motor. If the reference variable for the control changes, this also means a change in the characteristic curves for actuating the fan motor. In order to prevent the fan motor from whining, the operation of the fan motor is kept constant for a settable minimum waiting time when the reference variable for the control of the fan changes. During this minimum waiting time, the operating parameters of the cooling system can, if appropriate, be adapted by means of other control mechanisms which are independent of the fan to the new reference variable to such an extent that it is no longer necessary to take measures with respect to the whining of the fan motor.

19 Claims, 4 Drawing Sheets

METHOD FOR ACTUATING A FAN USING A PLURALITY OF CHARACTERISTIC CURVES AND A CONTROL PROGRAM FOR CONTROLLING THE POWER OF THE FAN

CROSS REFERENCE TO RELATED APPLICATION

This application claims the priority of German Patent Application No. 103 48 133.8, filed on Oct. 16, 2003, the subject matter of which, in its entirety, is incorporated herein by reference.

FIELD OF THE INVENTION

The invention relates to a method for controlling the power of a fan motor and to a control program with which the power of the fan motor is controlled. The method and control program are suitable in particular for actuating fan motors such as are used with fans in cooling systems for internal combustion engines. The control program determines here the power of the fan using characteristic curves of the fan motor and using the operating parameters of the cooling system and using predefined reference variables which predefine a temperature level to be set. However, the method and control program here are not restricted in any way to cooling systems in motor vehicles but rather can always be used wherever the aim is to set various temperature levels using a fan motor.

BACKGROUND OF THE INVENTION

A method of the generic type and a control program of the generic type are known from German Patent Application DE 197 28 814 A1. Various temperature levels are to be set in a cooling system for an internal combustion engine of a motor vehicle. The temperature levels which are to be set here are the reference variables for a fan control which determines the necessary power of the fan using a control program. The power of fan is determined here from the operating parameters of the cooling system, the predefined reference variable. Also from characteristic diagrams and characteristic curves of the fan motor. The operation of the fan is interrupted here until the coolant in the cooling system has reached and exceeded a minimum temperature. The intention here is to ensure that the internal combustion engine reaches the operating temperature as quickly as possible and that a cooling effect of the fan cannot occur prematurely. Once the fan function has been enabled, the control program adapts the power of the fan to the temperature level to be set. In particular two temperature levels of 90 degrees Celsius and of 108 degrees Celsius to which the power of the fan is to be adapted are provided here.

The abovementioned control of the power is thus an efficient method for reaching as quickly as possible the temperature levels which are predefined as reference variables. However, disadvantages result if the intention is to change over from a high temperature level to a low temperature level. The changing of the temperature level is in fact predefined by the changing of the reference variable for the control of the power. This reference variable changes here from 108 degrees Celsius to 95 degrees Celsius. For the control of the power of the fan motor this means that owing to the large temperature difference when the reference variable is changed from a high value to a low value it detects a large temperature difference with respect to the current actual temperature which is to be compensated as quickly as possible. This means that the fan motor whines at maximum power. This has the advantage that the lower temperature level is reached as quickly as possible, but is generally neither desirable nor necessary. The whining of the fan motor therefore leads to noise pollution and to unnecessary consumption of energy.

This is where the invention comes into play. The object of the invention is in fact to prevent whining of the fan motor when the temperature level to be set changes from a high value to a low value.

SUMMARY OF THE INVENTION

This object is achieved using a method as claimed in claim 1 and using a control program as claimed in claim 11. Advantageous refinements of the method according to the invention and of the control program according to the invention are contained in the subclaims and in the description of the exemplary embodiments.

The solution applies mainly to a power control process in which the power of the fan is determined from the characteristic curves of the fan motor, the operating parameters of the cooling system and the reference variables which are predefined in the form of temperature levels. The various temperature levels which are to be set have various associated characteristic curves for the actuation of the fan motor. If the reference variable for the control changes, this also means a change in the characteristic curves for actuating the fan motor. In order to prevent whining of the fan motor, the operation of the fan motor is kept constant for a settable minimum waiting time when the reference variable for the control of the fan changes. During this minimum waiting time, the operating parameters of the cooling system can, if appropriate, be adapted by means of other control mechanisms which are independent of the fan to the new reference variable to such an extent that it is no longer necessary to take measures with respect to the whining of the fan motor.

In one advantageous refinement of the invention, the starting up of the fan motor is damped using a filter which is connected into the circuit for actuating the fan motor. As a result, a slow startup of the fan is made possible even if large temperature differences with respect to the current actual temperatures of the system to be cooled occur when the temperature level to be set changes. This filter preferably has what is referred to as a PT1 characteristic.

Further advantageous refinements of the invention include the possibility of adapting the minimum waiting time until the fan motor starts and the method of a possibly necessary fan startup to the system conditions in a selective fashion. For this purpose, for example, the minimum waiting time can be shortened as a function of the thermal loading of the system to be cooled or the filter characteristics with which the starting up of the fan motor is influenced can be changed selectively so that the fan accelerates to higher power levels more quickly. When the system to be cooled and the ambient conditions are monitored by sensor, the chronological duration of the effectiveness of an adapted filter setting can be reduced if the ambient conditions change too strongly in comparison with what would still be appropriate for the selected filter settings. For this purpose, for example, the minimum waiting time for the interruption of the fan motor is set as a function of the temperature level to be set or the current operating parameters. Likewise, the filter settings are set as a function of the current operating parameters.

The invention is particularly suitable for use in cooling systems of internal combustion engines. In this case, relevant operating parameters according to which the filter settings and the minimum waiting time are selected are the current engine load of the internal combustion engine and the intake air temperature of the internal combustion engine.

BRIEF DESCRIPTION OF THE DRAWINGS

The invention is explained in more detail using the example of a cooling system for an internal combustion engine without restricting the general applicability. In this regard, reference is made to the following drawings, in which.

DETAILED DESCRIPTION OF THE INVENTION

Fan motors are usually used as a protection against overheating of a system to be cooled. The system to be cooled usually has here a primary temperature control in addition to the control of the fan. The temperature in the cooling system is preferably controlled using this primary temperature control. In particular in internal combustion engines, thermostats with which closed cooling circuits are switched over are used for the primary temperature control. Thermostats operate here in a significantly more energy-efficient fashion than fan motors and also have the advantage that the energy present in the system is retained better in the system by them. Fan motors have the disadvantage here that they use up a lot of energy merely for the purpose of taking energy out of an existing system. However, it is better to leave the energy in the system and to attempt to be able to obtain as much effective power as possible from it. The temperature control in a cooling system is therefore preferably carried out with an energy-efficient primary control, while the fan motor and the fan control are merely used as an additional protection if a reliable temperature control can no longer be maintained using the primary control. For this reason, in particular in motor vehicles, the fan is as far as possible not to be used for temperature control in the cooling system. However, in known fan controls from the prior art, problems occur here if, as already stated at the beginning, the temperature level in a cooling system is to be reduced from a high level to a lower temperature level. These problems are illustrated in FIG. 1 and at the same time the advantageous mode of operation of an inventive fan control is contrasted with the prior art.

Figure 1:
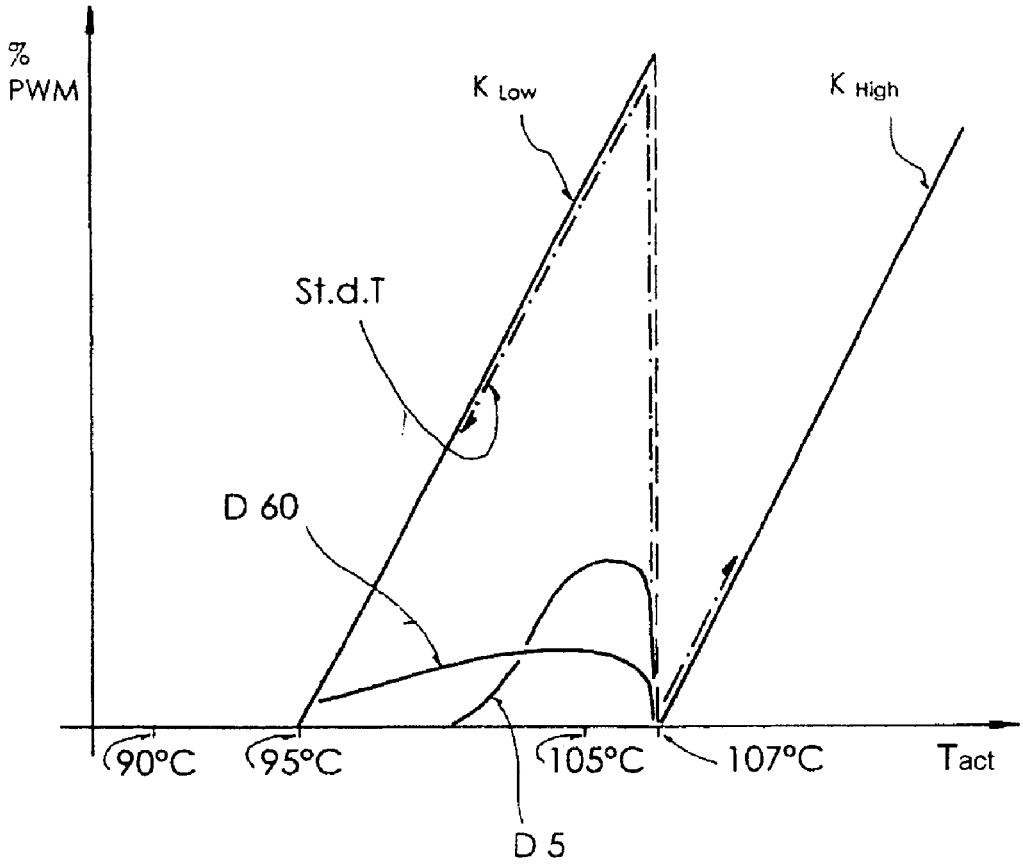
FIG. 1 shows a comparison between an incidence of the actuation of a fan from the prior art and two examples of the actuation of a fan according to the invention.

In FIG. 1, the sampling ratio of a pulse width modulation for actuating a fan motor is plotted as percentage PWM against the temperature in the cooling system. The cooling system is to be capable of setting two different temperature levels. One temperature level at 90 degrees and a second temperature level at 105 degrees Celsius. The temperature control is to be carried out mainly with the primary control. The fan is intended to cut in to prevent overheating if it is not possible to maintain the predefined temperature levels with the primary control. For this purpose, a threshold value above which the fan motor ensures the system is cooled more with increasing power as the temperature increases is typically provided for each temperature level. In the exemplary embodiment in FIG. 1, a threshold value of 95 degrees Celsius is provided for the temperature level of 90 degrees, and a threshold value of 107 degrees Celsius is provided for the temperature level of 105 degrees Celsius. The greater the deviation of the actual temperature from this threshold value, the more cooling power becomes necessary in order to return to the original temperature level to be set. For the PWM actuation of the fan motor, this results, in the simplest case, in the fan characteristic curves for each temperature level to be set, and in complex situations in temperature characteristic diagrams composed of a plurality of fan characteristic curves from which a desired actuation signal for controlling the power of the fan motor can be obtained for each actual temperature of the coolant in the cooling system. In the exemplary embodiment in FIG. 1, these curves are the two characteristic curves $K_{high}$, $K_{low}$ and when the temperature level to be set changes from 105 degrees Celsius to 90 degrees Celsius, the characteristic curve is also changed in principle from $K_{high}$ to $K_{low}$ for the fan control. However, the actual temperature of the cooling system will not be able to follow the change of the reference variable from 105 degrees Celsius to 90 degrees Celsius immediately. For this reason, with this scenario with fan controls from the prior art there is the following problem that when the reference variable changes to 90 degrees Celsius the fan control will detect extreme overheating of the cooling system and the fan motor will cut in at the upper power limit of its characteristic curve. The fan motor will whine volubly. FIG. 1 illustrates the profile of the actuation signal plotted against the pulse width modulation of the fan motor according to the prior art using a dot-dash line and designated by St-d-T. It is apparent that when the reference variable changes from high to low the working height will jump from the low point of the characteristic curve $K_{high}$ for the upper temperature level to an upper high point of the characteristic curve $K_{low}$ for the lower temperature level. The invention is intended to prevent this. According to the invention this is achieved in that, when a reference variable changes, the actuation of the fan is firstly suspended for a minimum time in order to allow the primary control to set the lower temperature level in the cooling system. If the lower temperature level has not yet been reached with the primary control after the minimum waiting time has expired, it is still always possible to prevent the fan motor from whining by taking measures to ensure that the fan motor does not cut in immediately at maximum power. This is done according to the invention by means of filters with which abrupt load changes at the fan motor are attenuated. This can be done, for example, by obtaining the actuation signal for the fan motor from the characteristic curve of the fan motor but not actuating the fan motor directly but rather ensuring, with an upstream filter, that the power of the fan approaches the working point of the fan characteristic curve asymptotically. During this time, the primary control has an opportunity to reduce the temperature, which will still be supported by the fan which is starting up gently. As a result of the delayed startup, possibly in combination with an additionally damped startup of the fan motor, the method according to the invention and the control program according to the invention instead provide a signal profile for the pulse width modulation of the fan motor such as is illustrated in curves D5 and D60. The profile of the curve D60 corresponds here to the highly attenuating filter, while the profile of the curve D5 corresponds to a weakly attenuating filter in the start-up control of the fan.

Figure 2:
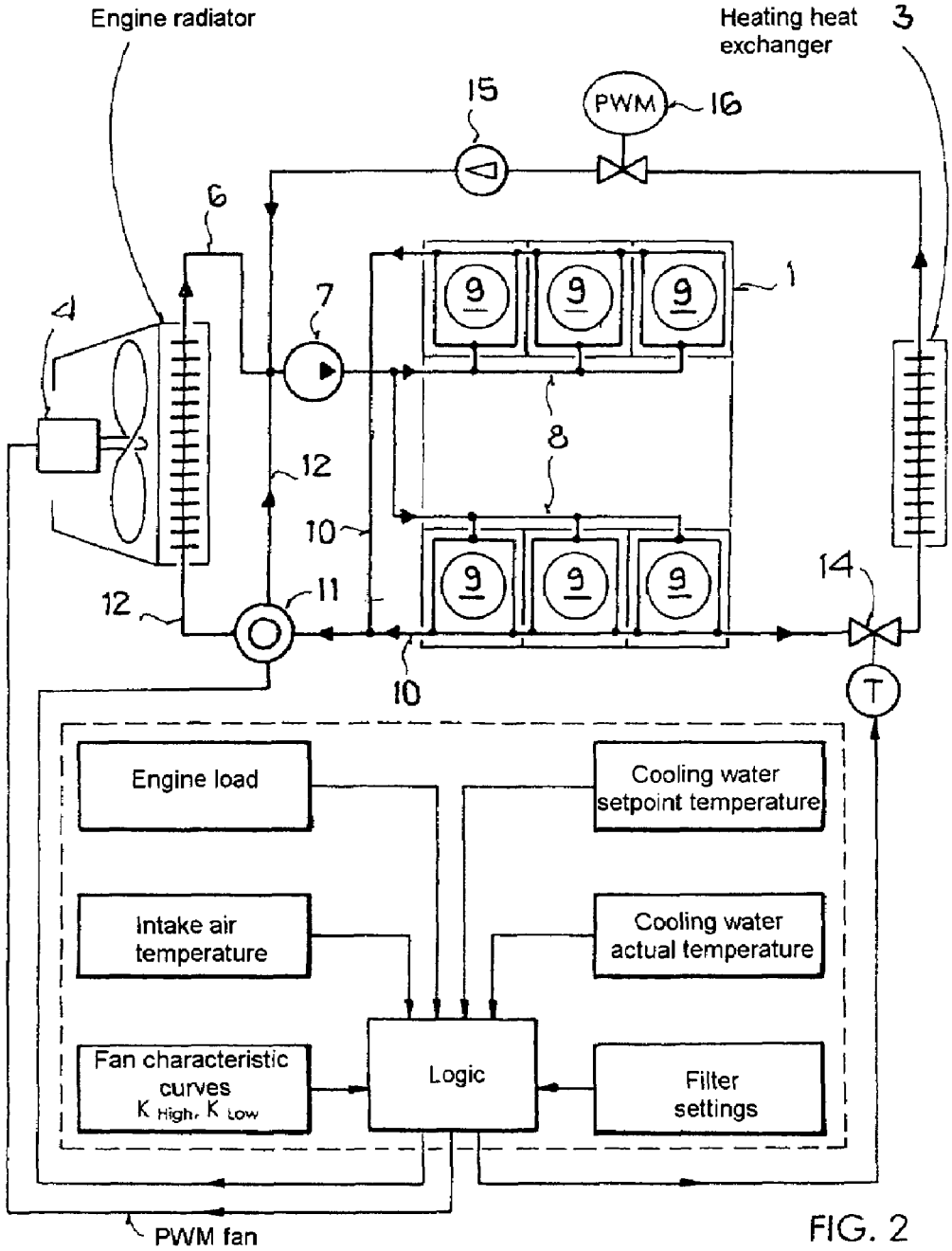
FIG. 2 shows a typical cooling system for an internal combustion engine in which the temperature control and the fan actuation are carried out with one control device in which the influencing variables which are the most important according to the invention are processed using one control device.

The fan control according to the invention is suitable in particular here for use in a cooling system for an internal combustion engine. FIG. 2 is a schematic view of a typical cooling system for a six-cylinder internal combustion engine 1. In addition to the internal combustion engine, a vehicle radiator 2 and a heating heat exchanger 3 are integrated into the cooling system. The cooling power of the vehicle radiator can be influenced with an electrically driven fan 4. In order to regulate the power of the fan, the electric motor of the fan is controlled with a control device 5. Coolant which has been cooled is extracted from the vehicle radiator by means of the forward feed line 6 and fed, by the coolant pump 7, into the cooling lines 8 in order to be fed to a cooling duct (not illustrated in more detail) for the combustion cylinders 9. The heated coolant is fed from the combustion cylinders 9 to a three-way thermostat 11 via return flow lines 10. Depending on the position of the valves in the three-way thermostat 11, the coolant passes from the internal combustion engine back into the vehicle radiator via the coolant return flow line 12 or via the radiator short-circuit 13 and the coolant pump 7 back into the cooling lines 8 of the internal combustion engine.

Depending on the position of the valves in the three-way thermostat 11, the cooling system can be operated here in a manner known per se in the short-circuit mode, in the mixed mode or in the large cooling circuit. The heating heat exchanger 3 is connected to the high temperature branch of the cooling system in the internal combustion engine via a temperature-controlled shut-off valve 14. The throughput rate through the heating heat exchanger after the shut-off valve 14 has been opened can be controlled in order to control the heating power, using an additional coolant pump 15 and a clocked shut-off valve 16.

The actuation of the activation elements at the valves of the three-way thermostat 11 is set here by the control device 5. The control device contains a logic component Logic in the form of a microelectronic computing unit. The control device is preferably formed by the control device in the motor electronics or is a component in the control device of the motor electronics. Here, the three-way thermostat 11 and the fan motor 4 are actuated using the control device 5. The actuation of the heating element of the three-way thermostat 11 is carried out here in a manner known per se. The three-way thermostat 11 is here the actuating element for the primary control mentioned at the beginning, which is also implemented as a control program for actuating the heating element in the three-way thermostat 11 in the control device 5. By suitably actuating the three-way thermostat 11 it is possible to set and control in particular three different temperature levels of 80 degrees Celsius, 90 degrees Celsius, and 105 degrees Celsius, in the cooling system for the internal combustion engine. The temperature levels are set here predominantly in a load-controlled fashion. This means that, of the requirements made of the engine, the temperature which is suitable for the current requirement is set in the cooling system from the operating modes of the internal combustion engine which can usually be tapped in the electronics of a modern internal combustion engine in the form of digital signal values. The most important influencing variable is here the engine load which is determined in particular from the engine speed, the sucked-in quantity of air or the fuel quantity injected into the combustion cylinders. If a satisfactory temperature control is no longer successful with the three-way thermostat 11 alone, the fan can be used for additional cooling. The fan motor 4 is also actuated here with the control device 5. The power of the fan motors is usually controlled with a pulse width modulation. For this purpose, the necessary cooling power is calculated from the operating parameters of the cooling system by a control program and when the currently necessary cooling power is known, the sampling ratio of the pulse width modulation with which the required cooling power can be provided is determined from the fan characteristic curves. The most important influencing variables for determining the suitable fan power are here the current engine load, the cooling water setpoint temperature, the cooling water actual temperature, the intake air temperature and the fan characteristic curves. If various temperature levels are to be set using the cooling system, various fan characteristic curves $K_{high}$, $K_{low}$ can be used for the various temperature levels.

According to the invention, the control program is then extended for the actuation of the fan motor to the effect that when the temperature level in the cooling system drops, the fan motor is prevented from starting up at least for a minimum waiting time and if it is still necessary to start up the fan after the minimum waiting time, the startup of the fan is attenuated in such a way that the working point of the fan control on the fan characteristic curve can be approached asymptotically. This is possible according to the invention with a control program such as is described in more detail below with respect to FIG. 3.

Figure 3:
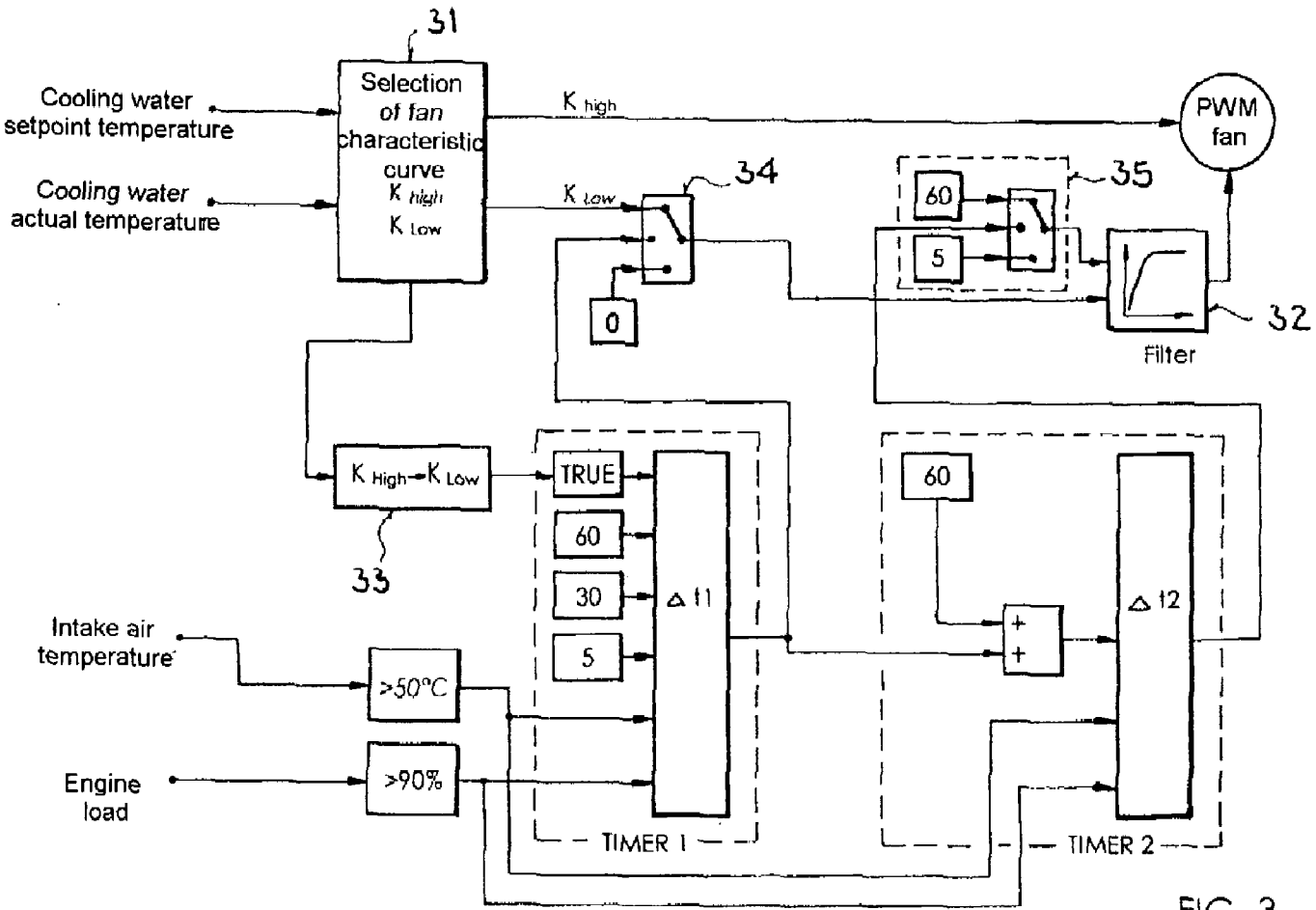
FIG. 3 shows a simplified functional framework and signal flow diagram for the method according to the invention and the control program according to the invention.

FIG. 3 shows the functional framework and the signal flow diagram of the control program according to the invention. At the input end, signal values which are preferably obtained from the engine control, and here from the engine control device, are processed by the control program. Said values are the cooling water setpoint temperature, the cooling water actual temperature, the intake air temperature as well as a characteristic variable for the engine load with which the internal combustion engine is being operated at a particular time. An associated fan characteristic curve or an associated fan characteristic diagram is selected using a program module 31 from the cooling water setpoint temperature predefined by the engine management system and is input into a main memory. By monitoring the cooling water actual temperature it is possible to use the program module 31 to find the working point at which the fan motor is to be operated in the current characteristic diagram of the fan or the current characteristic curve. The result of this processing process is an actuation signal to the electronic power system of the fan motor. This activation signal is preferably a pulse width modulation ratio with which the control of the fan motor is set.

If the cooling water setpoint temperature which is predefined by the engine management system changes, the process described above is carried out for the new cooling water setpoint temperature using the program module 31 to select a new fan characteristic curve. The program module 31 switches, as it were, from a characteristic curve $K_{high}$ for the high cooling water setpoint temperature to a characteristic curve $K_{low}$ for a lower cooling water setpoint temperature. Furthermore, the cooling water actual temperature is permanently monitored, so that a working point for the fan motor can also be found on the new fan characteristic curve $K_{low}$ and set. The changing of the cooling water setpoint temperature and the changing of the associated characteristic curve are evaluated in terms of programming using a subroutine 33. Checking is carried out to determine whether the cooling water setpoint temperature has changed from a high prescribed temperature value to a lower prescribed temperature value. If this is the case, a further program module, designated as Timer 1, is activated. In FIG. 3, the activation step is illustrated symbolically with the truth variable true. With the program module Timer 1, a minimum waiting time Δt1, during which the operating point of the fan motor is maintained, is calculated and determined as a function of further operating parameters of the system to be cooled. The elimination of changes to the power control of the fan motor is expediently carried out in such a way that a switching process 34 with which changes to the power control of the fan motor can be prevented is triggered using the program module Timer 1. How long the power control of the fan motor is to be switched off is determined from the current operating parameters of the internal combustion engine and of the cooling system. Minimum waiting times of 5 seconds, 30 seconds, and 60 seconds are provided and represented symbolically in FIG. 3 as input variables 5, 30 and 60 for inputting into the program module Timer 1. The most important influencing variables for determining the minimum waiting time are the currently present engine load, the currently present intake air temperature of the internal combustion engine, the current cooling water actual temperature and the magnitude of the temperature jump at the predefined cooling water setpoint temperature. In modern internal combustion engines, up to three different cooling water setpoint temperatures are predefined for the cooling system of the internal combustion engine and set by the engine management system depending on the power required of the internal combustion engine. Typical temperature levels for the cooling water setpoint temperatures are 80 degrees Celsius, 90 degrees Celsius and 105 degrees Celsius here. When the cooling water setpoint temperature changes from 105 degrees Celsius to 80 degrees Celsius, a minimum waiting time of 60 seconds is provided, and when the cooling water setpoint temperature changes from 105 degrees Celsius to 90 degrees Celsius a minimum waiting time of 30 seconds is provided. The abovementioned minimum waiting times can be aborted if necessary to protect against overheating of the cooling system or of the internal combustion engine. However, in all cases a minimum waiting time of 5 seconds is provided. The possibility of aborting the minimum waiting times when there is the risk of overloading constitutes a protective function for the internal combustion engine. This protective function is activated whenever the cooling water actual temperature exceeds a critical value of, for example, 107 degrees Celsius when the intake air temperature of the internal combustion engine is above 50 degrees Celsius or when the engine load of the internal combustion engine, determined from the rotational speed of the internal combustion engine and the degree of charging of the combustion cylinders, is above 90 percent of the maximum load of the internal combustion engine. In these cases, the minimum waiting time is shortened to 5 seconds using the Timer 1, or, if the overloading of the internal combustion engine occurs during the two relatively long waiting times of 60 seconds and 30 seconds, the relatively long minimum waiting times are aborted. The calculation of the current engine load and the determination of the current intake air temperature are also carried out here by the engine management system or the engine control device and are further processed by the control program according to the invention. In the simplest case, for this further processing program module Timer 1 contains comparison operations with which checking is carried out to determine whether or not the operating parameters of the cooling system and of the internal combustion engine lie in the ranges which are respectively defined as permissible.

After the minimum waiting time which is determined by the Timer 1 has expired, the low characteristic curve $K_{low}$, or to be more precise the activation signal—calculated on the basis of the low characteristic curve—to the fan motor, is enabled. The high characteristic curve $K_{high}$ is not switched and remains continuously active. The enabling of the characteristic curve is represented symbolically in FIG. 3 by the switching process 34, which may be embodied as a switch or preferably implemented using a switching operation carried out by a program. If the temperature difference between the new cooling water setpoint temperature and the current cooling water actual temperature is so large after the cooling water setpoint temperature has been switched over and after the minimum waiting time has expired that the fan has to be deployed again, the fan startup which is then possible is attenuated using the control program according to the invention. As a result, the fan is prevented from whining. The program module 31 calculates in a manner known per se whether a fan startup is necessary by checking whether the deviation of the cooling water actual temperature is greater than can be tolerated.

The attenuation of the fan startup is carried out with a settable digital filter 32 with which the actuation signal to the electronic system of the fan motor is filtered. The filter ensures the actuation signal present at the input end of the filter is transmitted to the filter output with a filter characteristic curve which approaches the input value asymptotically. The filter is preferably a filter with what is referred to as a PT1 characteristic. These filters are defined by a filter characteristic curve with an exponential profile, the time constant of the exponential function indicating after what time the output signal has reached 66 percent of the value of the input signal. By selecting the time constant of the exponential function it is possible for these filters to be adapted in terms of their effect and set. The invention also makes use of this by embodying the filter constant of the filter 32 in such a way that it can be exchanged using a subroutine 35. A time constant of 5 seconds and a time constant of 60 seconds are provided here. The switching over of the time constants of the filter is triggered by the program module Timer 2 by activating a selection process 35. The selection process is illustrated in FIG. 3 as a switching process, but is usually implemented as a selection process which is carried out by a program.

The duration of the filter settings of the abovementioned filter 32 is set using the program module Timer 2. The program module Timer 2 is used here mainly for resetting the time constants of the filter 32 from a high time constant to a lower time constant. In the exemplary embodiment of FIG. 3, these are the two time constants 5 seconds and 60 seconds for influencing the timing characteristic of the filter 32. The timer 2 is based here in terms of timing on the output signal of the program module Timer 1. To be more precise, the end of the minimum waiting time Δt1 is taken as the starting time for the activation of the program module Timer 2. When the minimum waiting time Δt1 starts or the characteristic curve $K_{low}$ is enabled, the time constant of the filter 32 is generally set to its high value of, for example, 60 seconds. This setting remains active until the filter constant is set again to the lower value of, for example, 5 seconds when there is a switchover signal from the program module Timer 2. This reset signal is output by the program module Timer 2 after a time period Δt2 expires, said time period Δt2 following the end of the minimum waiting time Δt1. This add-on time is, for example, generally 60 seconds. If there are no special circumstances present, the filter settings of the filter 32 remain active for the time period Δt2 of, for example, 60 seconds after the expiry of the minimum waiting time Δt1.

However, particular circumstances apply if there is a risk of overheating owing to an excessively high damping effect of the filter 32. This risk may be present if the filter settings permit only a slow fan startup. For this reason, a protective function is implemented using the program module Timer 2, said function permitting the time period of the filter settings to be shortened. For this purpose, the intake air temperature of the internal combustion engine and the current engine load of the internal combustion engine are also read out of the engine control device using the program module Timer 2 by monitoring the corresponding characteristic variables. If the intake air temperature exceeds the value of 50 degrees Celsius or if the engine load is above a value of 90 percent of the maximum possible engine load, the time constant of the filter 32 is reset immediately to the lower value of 5 seconds. As a result, if there is a risk of overloading, the fan can accelerate more quickly to its maximum power. The fan is in fact active more quickly with a shorter time constant of filter 32.

The interaction between the individual program modules as described in FIG. 3 and the method of operation of the control program according to the invention are explained below once more with reference to FIG. 4.

Figure 4:
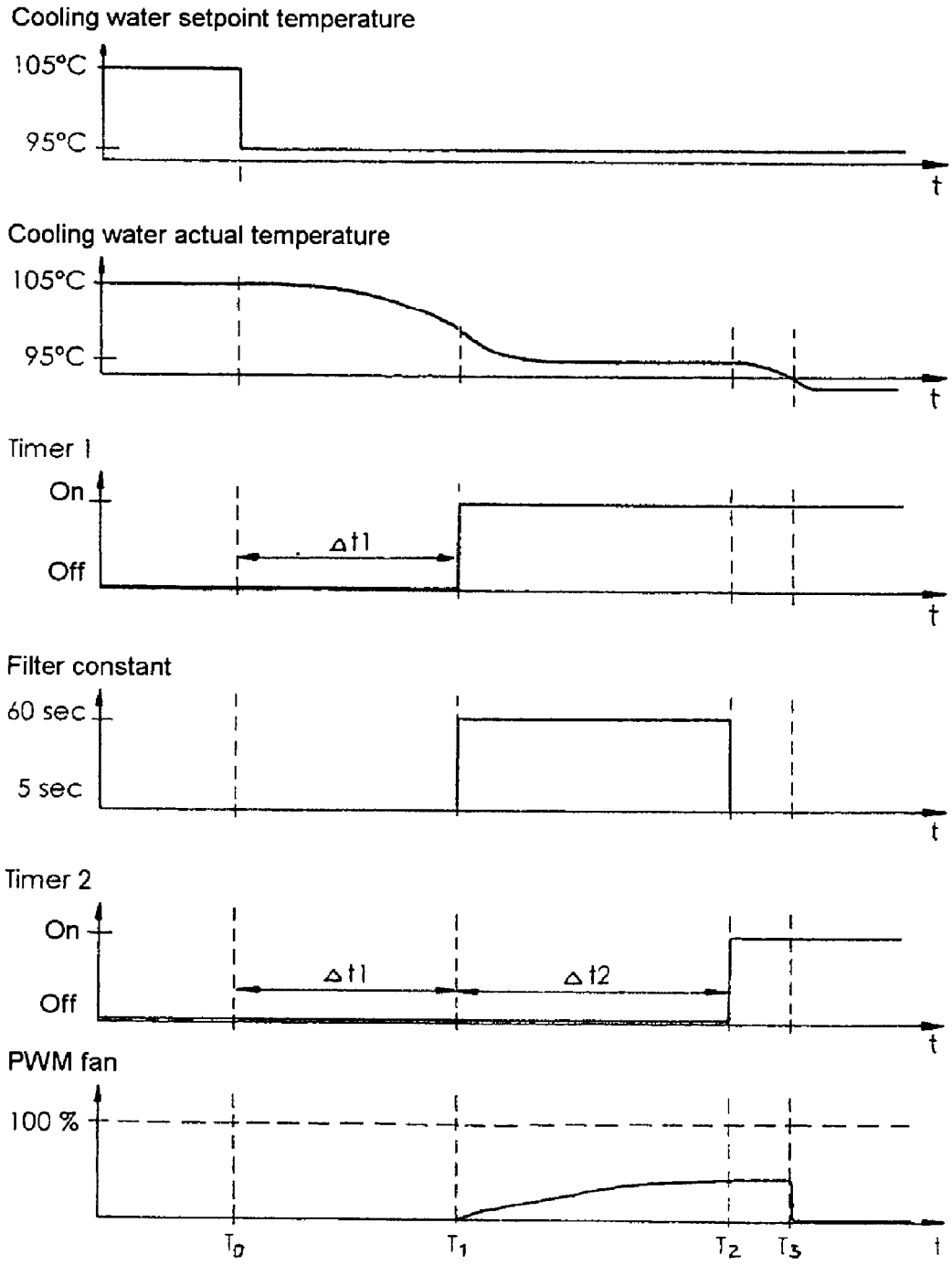
FIG. 4 shows a time sequence of the settings which are made with the signal flow plan according to FIG. 3 and their chronological influence on the fan and the actual temperature of the cooling water.

FIG. 4 shows in total six timing diagrams which relate to one another, the first diagram of which shows the time profile of the cooling water setpoint temperature, the second diagram shows the profile of the cooling water actual temperature, the third diagram shows the time profile of the signal level at the output of the program module Timer 1, the fourth diagram shows the switching over of the filter constant of the filter 32, the fifth diagram shows the signal level profile at the output of the program module Timer 2 and the sixth diagram finally shows the effects of the settings made with the control program on the PWM ratio for actuating the fan motor. The starting point of the entire process is the switching over of the cooling water setpoint temperature from a high value, here for example 105 degrees Celsius, to a lower value, here for example 95 degrees Celsius. When the switching over is carried out, the primary control is firstly active in order to control the temperature in the cooling system of the internal combustion engine. That is to say the thermostat 11 of the primary control is switched in such a way that the cooling water actual temperature begins to drop. For a time period Δt1 which is calculated and set by the program module Timer 1, the power control of the fan remains switched off up to the time T1. After the minimum waiting time Δt1 has expired, the actuation of the fan is enabled. However, the fan is actuated by means of the filter 32 which initially operates with the time constant of 60 seconds. The program module Timer 2 determines how long the filter settings are maintained. A time period Δt2 after which the filter constant of the filter 32 is reset from 60 seconds to 5 seconds is calculated and determined using the program module Timer 2. Afterwards, that is to say starting from the time T2, the filter operates up to the next changeover of the cooling water setpoint temperature with the time constant of 5 seconds. In the majority of cases, the resetting of the time constants of the filter will not have any influence any more on the pulse width modulation. In the majority of cases, the fan motor will in fact have accelerated to its working point on the new, enabled characteristic curve after the expiry of the time period Δt2, that is to say by the time T2. The resetting of the time constant has however the advantage that the fan control can react with a shorter time constant to a change in the working point. That is to say with a shorter time constant of the filter the fan motor can better follow migration of the working point on the fan characteristic curve.

With the primary control, after the end of the minimum waiting time Δt1 the cooling water actual temperature should generally have dropped below the activation threshold for the fan motor. This activation threshold is 95 degrees Celsius in the exemplary embodiment under discussion here. If the cooling water temperature has not dropped below this activation threshold, the fan is activated with an attenuated startup after the expiry of the minimum waiting time Δt1 at the time T1. The attenuation of the fan startup has the effect that the actuation signal for the PWM modulation of the fan approaches the working point on the fan characteristic curve asymptotically. This profile is illustrated in exemplary impression in the sixth diagram in FIG. 4. In the diagram for the cooling water actual temperature, the startup of the fan motor of course brings about a more rapid drop in the cooling water actual temperature to the new cooling water setpoint temperature of 95 degrees Celsius. If the cooling water actual temperature reaches the new setpoint temperature at the time T3, the support by the fan is no longer necessary and the fan can be switched off. The switching off of the fan is brought about here by virtue of the fact that the pulse duty ratio for the PWM modulation drops to zero.

It will be appreciated that the above description of the present invention is susceptible to various modifications, changes and adaptations, and the same are intended to be comprehended within the meaning and range of equivalents of the appended claims.

What is claimed is:

1. A method for controlling the power of a fan motor, in which the power is controlled with a fan control and which sets the power of the fan using a plurality of characteristic curves ($K_{high}$, $K_{low}$) of the fan motor and of operating parameters of a cooling system and the operating parameters of the cooling system contain a plurality of selectable temperature levels as a reference variable for the control of the power, wherein each temperature level has an associated characteristic curve ($K_{high}$, $K_{low}$) for controlling the power and wherein, when the reference variable is changed, the power control keeps the operation of the fan motor constant for a settable minimum waiting time (Δt1).

2. The method as claimed in claim 1, wherein, when the reference variable changes, the control changes the characteristic curve ($K_{high}$, $K_{low}$).

3. The method as claimed in claim 2, wherein, when the characteristic curve ($K_{high}$, $K_{low}$) changes, a damping filter is connected into the circuit for actuating the fan motor.

4. The method as claimed in claim 3, wherein the filter has a PT1 characteristic.

5. The method as claimed in claim 3, wherein the characteristic of the filter can be varied and set using a second program module (TIMER2).

6. The method as claimed in claim 5, wherein the time constants of the filter and the duration (Δt2) of the filter settings can be set using the second program module (TIMER2) and using a selection means.

7. The method as claimed in claim 3, wherein the time constant of the filter is set as a function of the current operating parameters.

8. The method as claimed in claim 1, wherein the minimum waiting time (Δt1) can be varied and set using a program module (TIMER1).

9. The method as claimed in claim 1, wherein the minimum waiting time (Δt1) is set as a function of the temperature level which is to be set or the current operating parameters.

10. The method as claimed in claim 9, wherein the operating parameters are in particular the engine load and intake air temperature of an internal combustion engine.

11. A control program on a computer readable medium for controlling the power of a fan motor with which the power of the fan is set using a plurality of characteristic curves ($K_{high}$, $K_{low}$) of the fan motor, using current operating parameters of a system to be cooled and using reference variables in the form of temperature levels, wherein the control program has a program module for selecting and for changing the characteristic curve of the fan motor, the characteristic curve ($K_{high}$, $K_{low}$) which is to be selected being selected using a reference variable which is predefined at interfaces, and wherein the control program has a program module (TIMER1) with which, when the characteristic curve ($K_{high}$, $K_{low}$) changes, the operation of the fan motor is kept constant for a minimum waiting time (Δt1).

12. The control program as claimed in claim 11, wherein the control program contains a digital filter which, when the characteristic curve changes, is included in the program sequence for actuating the fan motor.

13. The control program as claimed in claim 12, wherein the characteristic of the digital filter can be varied and set using the program module (TIMER2) and a selection means.

14. The control program as claimed in claim 13, wherein the time constants of the filter and the duration (Δt2) of the filter settings can be set using the program module (TIMER2) and the selection means.

15. The control program as claimed in claim 13, wherein the characteristic of the digital filter is set as a function of the current operating parameters.

16. The control program as claimed in claim 12, wherein the digital filter has a PT1 characteristic.

17. The control program as claimed in claim 11, wherein the minimum waiting time (Δt1) can be varied and set using a program module (TIMER1).

18. The control program as claimed in claim 11, wherein the minimum waiting time (Δt1) is selected as a function of the reference variable or the current operating parameters using a program module (TIMER1).

19. The control program as claimed in claim 18, wherein the operating parameters are in particular the engine load and the intake air temperature of an internal combustion engine.

* * * * *